United States Patent [19]

Harada et al.

[11] Patent Number: 4,613,298

[45] Date of Patent: Sep. 23, 1986

[54] OIL BURNER

[75] Inventors: Toyohei Harada, Nara; Muneo Tao, Yamatokoriyama, both of Japan

[73] Assignee: Matsushita Electric Industrial Co., Ltd., Osaka, Japan

[21] Appl. No.: 744,259

[22] Filed: Jun. 13, 1985

[30] Foreign Application Priority Data

Jun. 19, 1984 [JP] Japan ..... 59-125953

[51] Int. Cl.[4] ..... F23N 5/24

[52] U.S. Cl. ..... 431/88; 431/33; 431/301; 126/96

[58] Field of Search ..... 431/88, 33, 301, 306, 431/307, 298; 126/96, 97, 93

[56] References Cited

U.S. PATENT DOCUMENTS 4,363,620 12/1982 Nakamura et al. ..... 431/88 X
4,417,870 11/1983 Nakamura et al. ..... 431/88 X

FOREIGN PATENT DOCUMENTS 142630 11/1979 Japan ..... 431/88
052709 3/1982 Japan ..... 431/88

*Primary Examiner*—Randall L. Green

*Attorney, Agent, or Firm*—Stevens, Davis, Miller & Mosher

[57] ABSTRACT

An oil burner is of the type which enables controlling a degree of burning and performing fire extinguishing by vertically moving a wick. The invention is directed to restricting the control of burning within a range of normal combustion, removing the restriction to manually perform fire extinguishing, and automatically performing fire extinguishing when vibrations are sensed by a vibration sensor. The oil burner includes a slide shaft mounted on a wick shaft and a rotary member mounted on the wick shaft and enabling moving when axially pushed by the slide shaft. The rotary member is interlocked with the wick shaft by an actuation member provided on the wick shaft, and is provided with a stop member which stops the wick shaft at a predetermined position in rotating in a wick lowering direction. The rotary member is biased in the wick lowering direction by a spring which conserves resilience when the wick is elevated by operating the wick shaft, and is locked by a lock member in rotating in the wick lowering direction. The locking of the rotary member by the lock member can be released when vibrations are sensed by a vibration sensor.

5 Claims, 15 Drawing Figures

OIL BURNER

BACKGROUND OF THE INVENTION

1. Field of the Invention

This invention relates to an oil burner which controls combustion and fire extinguishing by means of vertical movements of a wick.

2. Description of the Prior Art

An oil burner which controls combustion and fire extinguishing by means of vertical movements of a wick is generally provided with a burner portion 2 on a tank 1, as shown in FIGS. 7 to 10. A wick 3 which is constantly urged downwardly is provided in the burner portion 2 to be vertically movable through a rack 5 and a pinion 6 by a wick shaft 4. A ratchet 9 is mounted on the wick shaft 4 through friction members 10, 11, and a retainer 8 is secured to the wick shaft 4. A rotary plate 13 with a pin 14 is attached to the retainer 8 and a through hole 15 is formed in the ratchet 9 at a position corresponding with the pin 14.

The pin 14 is passed through the through hole 15 to enable vertical movements of the wick 13 within the range of the through hole 15 or controlling the extent of combustion as well as preventing incomplete combustion due to excessive descent of the wick 13. A vibration sensor 16 is attached to the tank 1. The vibration sensor 16 comprises a weight 17, an extinguishing knob 18 and a lever 19 which is operated by the weight 17 and the extinguishing knob 18. A latch portion 20 at the end of the lever 19 is adapted to engage with a tooth 9' of the ratchet 9 so as to prevent the ratchet 9 from rotating in the wick lowering direction. The ratchet 9 is able to rotate until the protrusion 9'' provided on the ratchet 9 abuts against the latch portion 20; in other words, the maximum angle of rotation of the ratchet 9 is determined to be one rotation and the wick 3 moves vertically within this range. A knob 21 is fixed to the wick shaft 4.

In an oil stove as described above, when the knob 21 is rotated in the wick elevating direction, the wick 3 is elevated while accumulating force through the rack 5 and the pinion 6. At this time, the ratchet 9 is caused by means of the frictional force of the friction members 10, 11 to rotate together with the wick shaft 4. When the operating force applied on the ratchet 9, and thus the operating force applied on the knob 21 is released, the tooth 9' is retained by the latch portion 20 and the wick 3 is maintained at a predetermined level. In controlling the level of the wick 3, the knob 21 is rotated in the wick lowering direction (opposite to the wick elevating direction), whereby the wick shaft 4 can rotate together with the friction members 10, 11 in against the frictional force thereof, while the ratchet 9 can not be rotated due to its engagement with the latch portion 20 of the lever 19. In this way, the level of the wick is controlled within the range of the through hole 15 within which the pin 14 is movable.

In lowering the wick for extinguishment in the normal state, the engagement of the tooth 9' with the latch portion 20 is released by the operation of the lever 19 at a touch to the extinguishing knob lever 18, whereby the stored force of the wick 3 is released and the wick 3 rapidly descends to the lowermost position to immediately extinguish a flame in a very simple and convenient operation. On the other hand, in unusual circumstances, for example, when an earthquake happens during use, the weight 17 detects this and operates the lever 19.

Accordingly, the wick 3 rapidly descends to the lowermost position in a similar manner to the extinguishing operation of the extinguishing knob 18, whereby immediate extinguishment is effected.

The conventional oil stove described above is very suitable for countries having regulations according to which the level of a wick must be positively stopped at a predetermined position, and must not be lower than a predetermined position by the same operation (hereinunder referred to as "one-touch extinguishment system") in order to safely maintain the charactaristics of exhaust gases, temperatures and the like. On the other hand, the knob 21 for vertically moving the wick permits the wick 3 to descend within the range of the through hole 15 formed in the ratchet 9, and further descent of the wick can not be performed except for the case where fire extinguishing is performed in rapid descent of the wick by the operation of the extinguishing knob 18. For this reason, in oil-limited countries where a mixture of different kinds of fuels such as fuel containing much heavy gravity constituent or light oil is used, tar or the like is produced at the end of the wick 3 such that accumulation of tar or the like cancels or overcomes the reserving descent force of the wick to prevent descent of the wick. Moreover, when the wick 3 is caught at a position where fire extinguishing is impossible, burning continues to be very dangerous even if the user tries to extinguish the fire by the one-touch operation of the extinguishing knob 18. In order to extinguish the fire in this case, it is necessary to manually turn the knob 21 with the extinguishing knob 18 operated, namely the engagement of the latch portion 20 by the tooth 9' is released. This operation is very difficult to understand and perform particularly when attempted in an emergency when the fire has not been successfully extinguished.

In these countries, greater importance is attached to durability of a wick and safe fire extinguishing than to such convenience as is offered by the one-touch fire extinguishing system. So, a structure in which fire extinguishing is ensured by rotating the knob 21 by hand, (hereinunder referred to as "manual fire extinguishing system") has been in demand since a user can put forth his strength.

An example of an oil burner which affords the above-described manual fire extinguishing is shown in FIGS. 11 and 12, and is put to practical use. In FIGS. 11 and 12, the reference numeral 23 denotes a vertically movable wick, **23*a* a wick holder integrally attached to the wick 23, 24 a rack member integrally secured to the wick holder 23*a*, and 24*a* a rack which is formed in the circumferential direction of the oil burner and is inclined relative to the horizontal, as shown in FIG. 12. The reference numeral 25 represents a wick shaft for vertically moving the wick 23, and 26 a pinion which is provided on the forward end of the wick shaft 25 and is intermeshed with the rack 24*a* of the rack member 24. Thus rotation of the wick shaft 25 elevates the wick 23 while rotating it through the pinion 26 and the rack 24*a*. The wick shaft 25 is slidable in the axial direction and is urged toward the wick holder 23*a* by a spring 27. The wick holder 23*a* is formed with a resilient cutaway protrusion 28 which is disposed on the path of contacting movement of the forward end 25*a* of the wick shaft 25. In the state where the wick 23 is lowered, one end 24*a'* of the rack 24*a* is meshed with the pinion 26 of the wick shaft 25, as shown by an imaginary line in FIG. 11**.

When the wick shaft 25 is rotated in this state, engagement of the rack 24*a* with the pinion 26 causes, the rack member 24 to be rotated and elevated. As the wick shaft 25 is rotated even after the cutaway protrusion 28 of the wick holder 23*a* comes into contact with the forward end 25*a* of the wick shaft 25, the cutaway protrusion 28 is deformed toward the wick and passes the forward end 25*a* of the wick shaft 25, until the other end 24*a*" of the rack 24*a* abuts against the pinion 26, and is stopped. Thus, the wick 23 is elevated to the uppermost position. When the wick shaft 25 is rotated in the revese direction from this position in order to control combustion, the cutaway protrusion 28 of the wick holder 23*a* abuts against the forward end 25*a* of the wick shaft 25, as shown by the solid line in FIG. 11, and further rotation of the wick shaft 25 is restrained. In other words, the wick 23 is restrained from lowering further. In order to further lower the wick 23 for the purpose of fire extinguishing, the wick shaft 24 is rotated while being pulled toward the user against the bias of the spring 27 so that the cutaway protrusion 28 disengages from the forward end 25*a* of the wick shaft 25.

As described above, this oil burner can stop the wick at a predetermined level without fail as well as enabling a manual extinguishment by releasing the stopping.

However, this oil burner is disadvantageous in that it can not be applied to an anti-earthquake extinguishment device which is adapted to lower the wick upon detection of vibration by a vibration sensor used in combination with the device. More specifically, when actuation of the vibration sensor permits the spring 27 to apply its bias on the wick shaft 25 for rotation in the wick descending direction, the cutaway protrusion 28 of the wick holder 23*a* abuts against the forward end 25*a* of the wick shaft 25 and is stopped at the lower end of the range in which the level of the wick is controlled, whereby the wick shaft 25 can not be lowered to the level of extinguishment.

As described above, in the prior art, there has not been proposed any structure, in which a range for use is definitely limited to prevent further rotation of a wick shaft beyond the lower limit, and in which such limitations are made ineffective by a simple operation to afford fire extinguishing by manual rotation of the wick and lowering the wick to a level for fire extinguishing by operation of an anti-earthquake extinguishment device.

SUMMARY OF THE INVENTION

Accordingly, it is an object of the invention to solve the above-described problems and to provide an oil burner with high safety in which the level of a wick can be definitely restricted for normal burning, which affords manual extinguishment by removing the restriction by a simple operation, and which incorporates an anti-earthquake extinguishment device which is actuated normally.

To achieve this aim, the invention provides an oil burner having a wick elevating and lowering structure which holds the descent of a wick at a predetermined level, and affords usual extinguishment by pushing and turning a knob for releasing the holding condition, and in which the wick can be rapidly lowered down to the extinguishment level by a spring force when vibration or burnover of the burner is detected.

Figure 1:
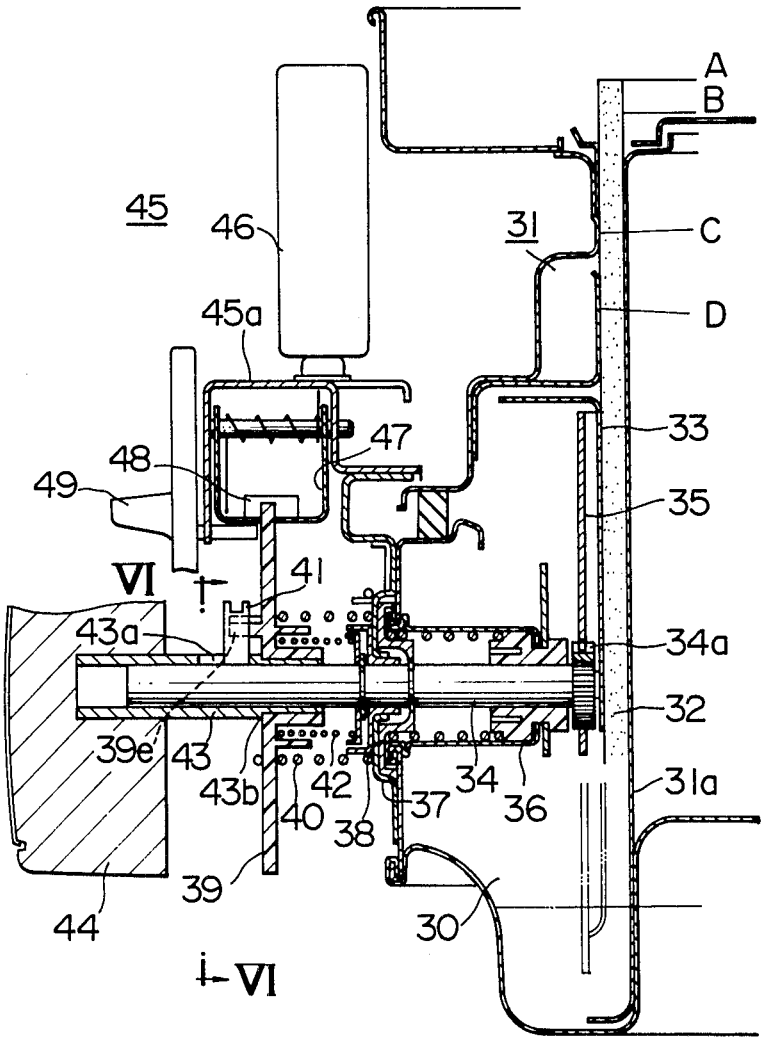
FIG. 1 is a sectional view of a wick controlling device incorporated in an oil burner according to an embodiment of the invention.
Figure 2:
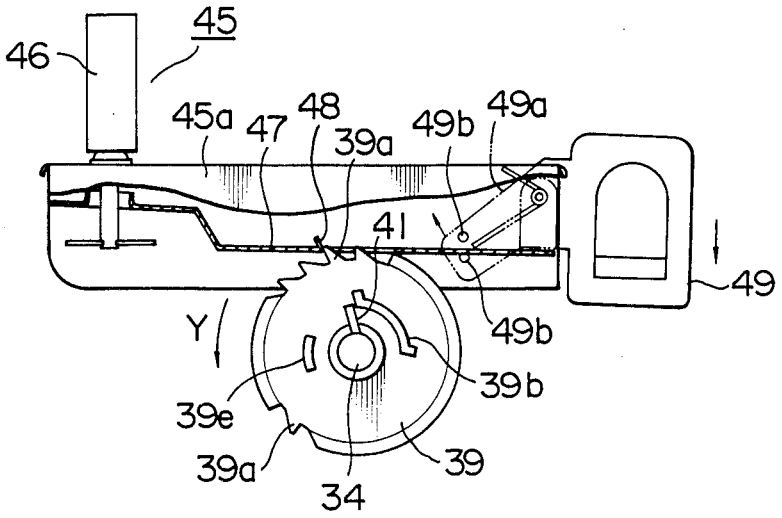
FIG. 2 is a front view of an anti-earthquake extinguishment device incorporated the embodiment in FIG. 1.
Figure 3:
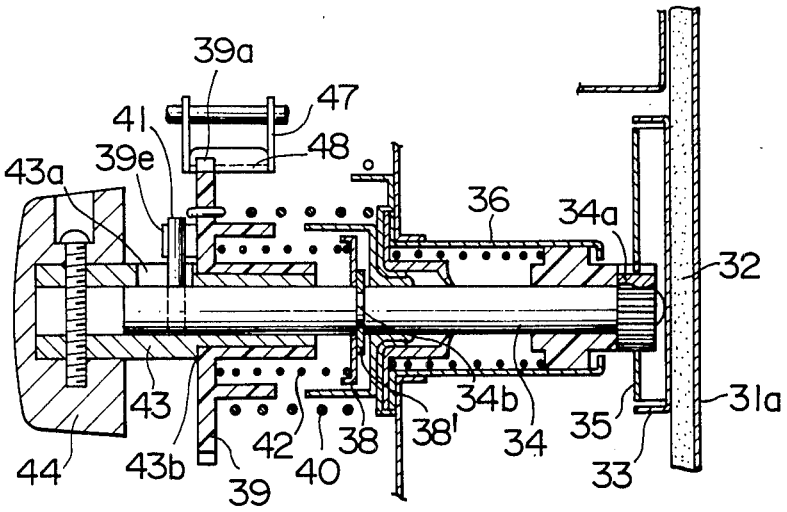
FIGS. 3 and 4 are sectional views of an essential part of the embodiment, FIG. 3 showing it during the burning condition, and FIG. 4 showing it in the state of manual extinguishment.
Figure 4:
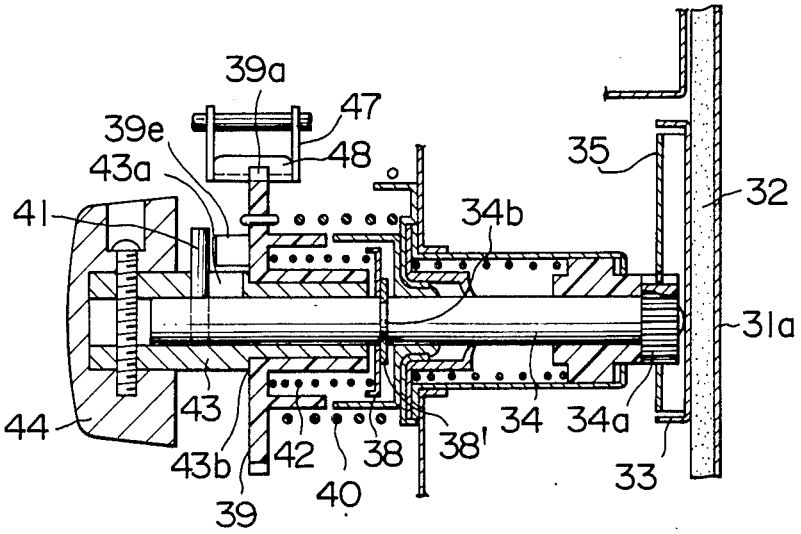
Figure 5:
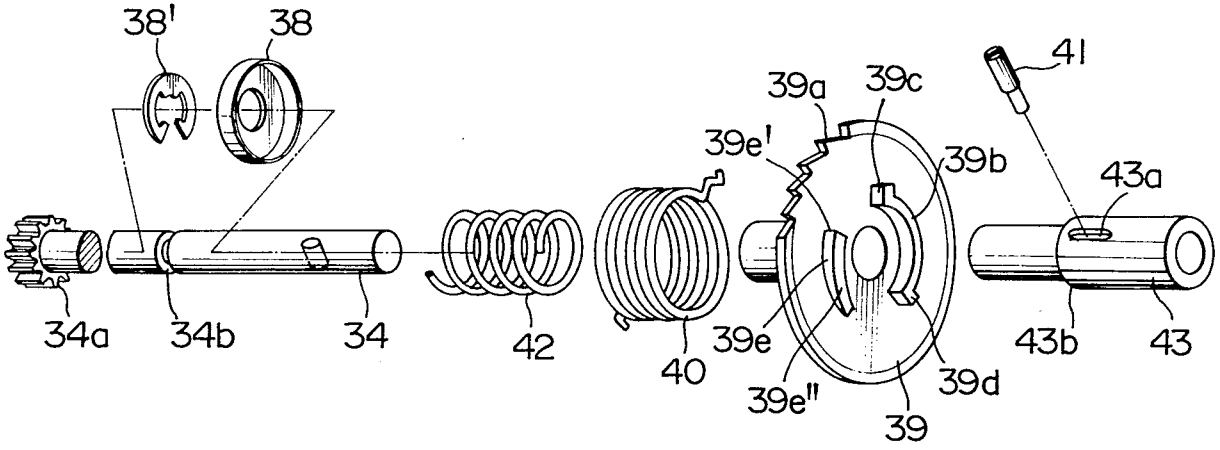
FIG. 5 is an exploded perspective view of the essential part shown in FIG. 3.

The above and other objects, features and advantages of the present invention will become apparent from the following description of the preferred embodiment thereof, taken in conjunction with the accompanying drawings.

DESCRIPTION OF THE PREFERRED EMBODIMENT

Hereinunder an embodiment will be with reference to the accompanying drawings. Referring first to FIGS. 1 to 6D, the reference numeral 30 denotes a tank provided with a burner portion 31, 32 a wick mounted on the burner portion 31 through a wick holder 33, and vertically movable between the wick holder 33 and a wick guide cylinder 31*a*. A wick shaft 34 has a pinion 34*a* at its forward end, which pinion 34*a* is engaged with a rack 35 provided on the wick holder 33 for the purpose of vertically moving the wick 32. The reference numeral 36 represents a bearing for supporting the wick shaft 34, and 37 a bearing fitting secured to the tank 30 for supporting a wick shaft packing 38 and the like. A rotary member 39 formed of a polyacetal resin or the like and provided with a plurality of saw-toothed engaging portions 39*a* on the peripheral edge thereof is rotatably fitted over the wick shaft 34 and is integrally formed with a latch member 39*b* having bent portions 39*c* and 39*d*, and a stop piece 39*e*. The Reference numeral 40 denotes an extinguishment spring for lowering the wick, which spring 40 is prestressed by winding and fitted around the rotary member 39 with one end thereof anchored at on one portion of the bearing fitment 37 and the other end thereof at the rotary member 39. An actuation pin 41 is implanted in the wick shaft 34 at such a position as to move between the bent portions 39*c* and 39*d* provided on the rotary member 39, and the rotary member 39 is biased against the actuation pin 41 by the axial bias of a spring 42. One end of the spring 42 is supported against a member 38' such as a washer stop ring which is fitted in a groove 34*b* formed on the wick shaft 34. In this way, both the rotary member 39 and the actuation pin 41 are closely contacted to each other to slide by predetermined force. Since the rotary member 39 is biased by the force conserving extinguishment spring 40 to rotate in the wick lowering direction (in the direction indicated by the arrow y in FIGS. 2 and 6), the bent portion 39*c* of the latch member 39*b* provided on the rotary member 39 abuts against the actuation pin 41 to rotate the wick shaft 34 in the wick lowering direction (the direction indicated by the arrow Y). The stop piece 39*e* provided on the rotary member 39 is disposed on the path of rotation of the actuation pin 41, and includes a high stop surface 39*e'* for temporarily stopping the actuation pin 41 during the rotation of the wick shaft in the wick lowering direction, and a tapered surface 39*e''* which the actuation pin 41 biasingly rides over during the rotation of the wick shaft in the wick elevating direction.

A slide shaft 43 is slidably fitted on the outer peripheral surface of the wick shaft 34, and receives the actuation pin 41 in its slot 43*a* which makes the slide shaft 43 freely movable relative to the pin 41 in the axial direction and restrains the slide shaft 41 in the circumferential direction. The slide shaft 43 is formed with a step 43*b* which is adapted to abut against the rotary member 39. The reference numeral 44 designates a knob mounted on the end of the slide shaft 43 for vertical movement of the wick.

A vibration sensor 45 attached to the bearing fitting 37 is operated by a weight 46 for detecting vibration and includes a lever 47 which is constantly biased against and into engagement with the rotary member 39. The lever 47 is provided with a lock member 48 which engages with the engaging portions 39*a* of the rotary member 39, and engagement of the lock member 48 with the rotary member 39 prevents the rotary member 39 from rotating in the wick lowering direction due to the conserved forced of the extinguishment spring 40.

The reference numeral 49 represents a manual extinguishment member which is rototably supported by a vibration sensor base plate 45*a* on the lever 47. The member 49 serves to actuate lever 47 through pins 49*b*, 49*b* implanted on the arm portion 49*a*.

In the above-described construction, the manual extinguishment system will first be described. When the knob 44 is rotated in the wick elevating direction, the rotary member 39 is rotated through the slide shaft 43, the actuation pin 41 and the wick shaft 34 to conserve resilience in extinguishment spring 40. The rack 35 is driven by the pinion 34*a* to elevate the wick holder 33 and the wick 32 which are integral with the rack 35.

Figure 6A:
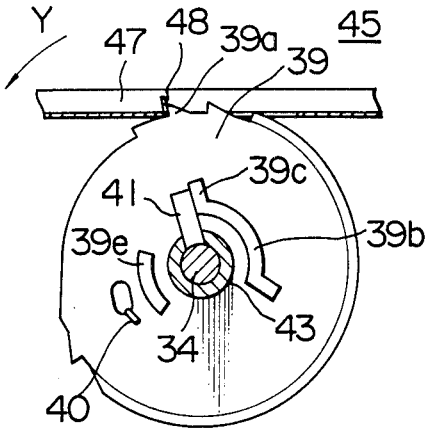
FIGS. 6A to 6D are views of the embodiment taken along the line VI—VI in FIG. 1, FIG. 6A showing the embodiment when the wick is being elevated to the uppermost level, FIG. 6B showing the embodiment when the wick is lowered down to the lower limit of the normal burning range, FIG. 6C showing the embodiment when the wick is lowered down to the extinguishment position by a wick shaft, and FIG. 6D showing the embodiment when the wick is lowered being by an anti-earthquake extinguishment device for fire extinguishing.

When the wick 32 reaches the top level, elevation of the wick 32 is stopped where the engaging portions 39*a* of the rotary member 39 intermesh with the lock member 48 of the vibration sensor 45 to prevent lowering of the wick. The level of the wick at this time is at the uppermost point A in FIG. 1. The positional relationship in the circumferential direction between the actuation pin 41 and the rotary member 39 is as shown in FIG. 6A; the actuation pin 41 abuts against the bent portion 39*c* of the rotary member 39.

Figure 6B:
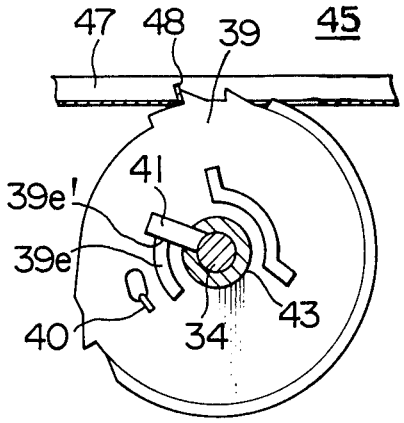

When the wick is to be lowered for controlling the condition of burning, the knob 44 is rotated in the wick lowering direction (in the direction of the arrow Y) until the actuation pin 41 abuts against the stop member 39*e* provided on the rotary member 39, as shown in FIG. 6B. The wick at this time is positioned at the level B in FIG. 1. Thus the wick is controllable between the levels A and B. This range of control is set in a manner to provide normal burning, so that there is no incomplete burning caused by excessive lowering of the wick.

In order to further lower the wick 32 for extinguishment, the knob 44 is pushed in the axial direction and subjected to turning force in the wick lowering direction, so that the slide shaft 43 is axially moved to cause its step 43*b* to retreat the rotary member 39 against the bias of the spring 42. Thus the stop piece 39*e* comes to a position behind the actuation pin 41 to be out of engagement therewith, so that the wick shaft 34 can be rotated in the direction for extinguishment.

Figure 6C:
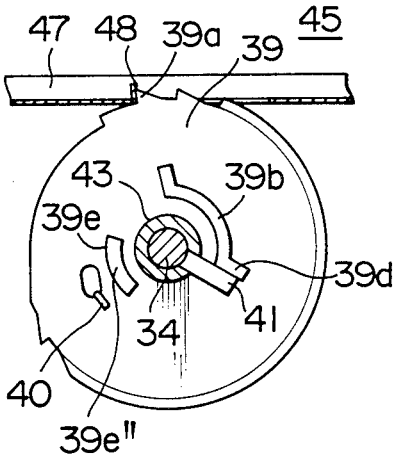

It suffices to push the slide shaft 43 only when the actuation pin 41 is to be disengaged from the stop piece 39*e*, and then to rotate the wick shaft 34 in the wick lowering direction. As shown in FIG. 6C, the wick shaft 34 is rotated until the actuation pin 41 abuts against the bent portion 39*d* of the latch member 39*b*. The wick at this time is positioned at the level C shown in FIG. 1. The level C is set at a position where extinguishment is completed within a predetermined period of time (about 300 seconds) which is generally considered to be the maximum time for safely extinguishing an oil burner. (Hereinunder this level is referred to as a "first extinguishment level"). In ordinary use, the wick is positioned within the range from A to C. By rotating the knob 44 in the wick elevating direction, the wick 32 is elevated up to the uppermost level A, ignited at the position A, and burned in a combustion cylinder (not shown) mounted on the burner portion 31. In order to obtain the optimum burning condition, the level of the wick 32 is controlled within the range from A to B. In order to perform extinguishment, the knob 44 is axially pushed and manually rotated in the wick lowering direction, whereby the wick 32 is lowered down to the level C (first extinguishment position) and fire extinguishing is performed.

When the knob 42 is rotated in the wick elevating direction for another use, the actuation pin 41 rotates along the tapered surface 39*e''* of the stop piece 39*e* to a position such that the wick reaches the uppermost level A (the actuation pin returns to the position shown in FIG. 6A).

Figure 6D:
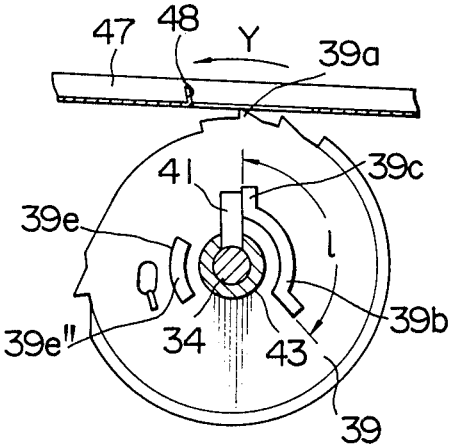
Figure 7:
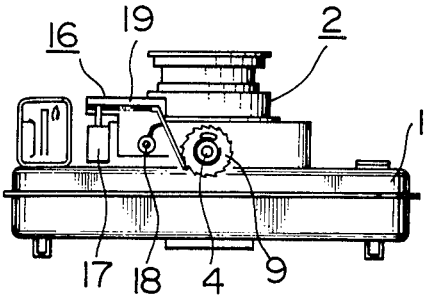
FIG. 7 PRIOR ART
FIG. 7 is a front view of a conventional oil burner.
Figure 8:
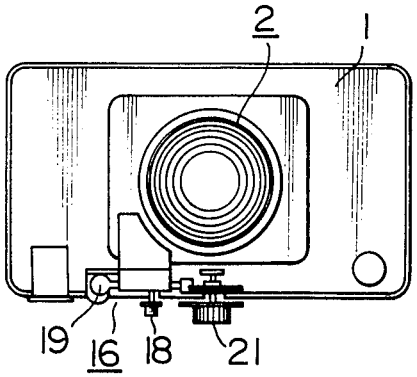
FIG. 8 PRIOR ART
FIG. 8 is a top plan view of the burner in FIG. 7.
Figure 9:
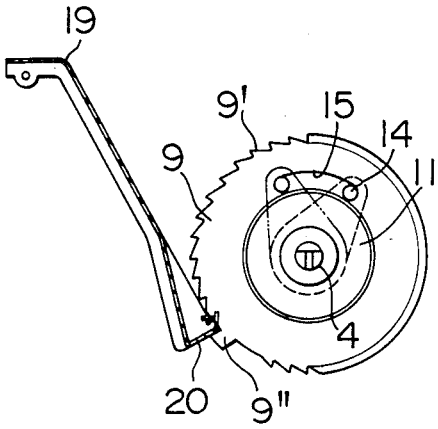
FIG. 9 PRIOR ART
FIG. 9 is a front view of an essential part of the burner shown in FIG. 7.
Figure 10:
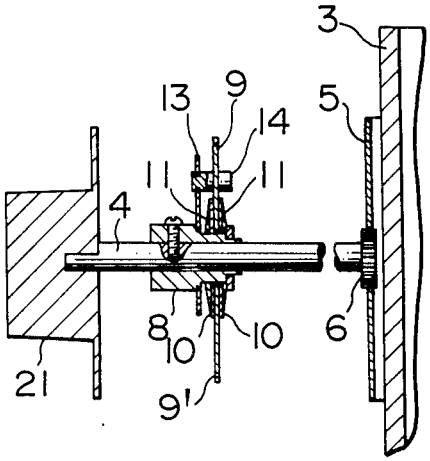
FIG. 10 PRIOR ART
FIG. 10 is a sectional side elevational view of the essential part shown in FIG. 9.
Figure 11:
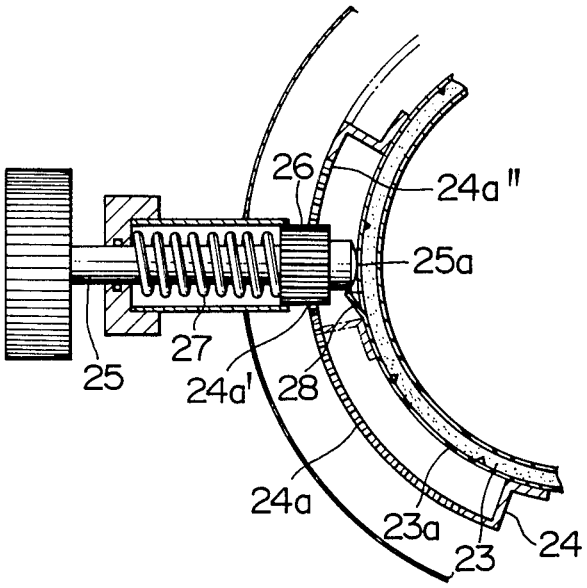
FIG. 11 PRIOR ART
FIG. 11 is a sectional view of another conventional oil burner.
Figure 12:
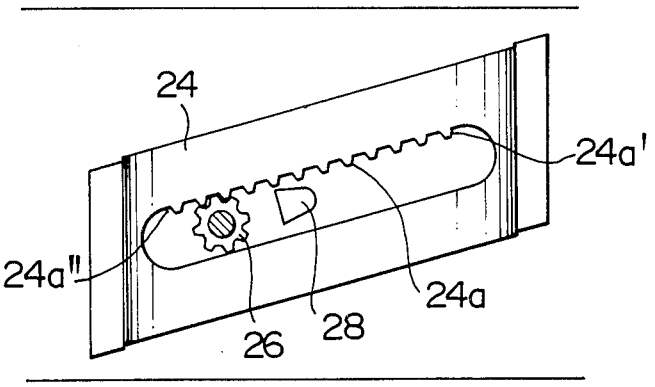
FIG. 12 PRIOR ART
FIG. 12 is a front view of a rack portion of the burner shown in FIG. 11.

On the other hand, when the oil burner is subjected to vibration as in an earthquake or the like, or falls down to be shocked (under certain extraordinary circumstances), the vibration sensor 45 operates to disengage the lock member 48 from the engaging portions 39*a* of the rotary member 39, as shown in FIG. 6D, whereby the rotary member 39 is caused by the bias of the extinguishment spring 40 to rotate in the wick lowering direction (in the direction indicated by the arrow Y), which movement is transmitted to the actuation pin 41 and the wick shaft 34 to permit the bias of the spring to instantaneously lower the wick. The amount of this rotation is greater than that of the manual rotation of the knob 44 by an amount corresponding to the length l of the latch member 39*b*, and the wick 32 is lowered down to the level D beyond the first extinguishment position or level C. Thus fire extinguishing is instantaneously completed to prevent a fire from being caused. (Hereinunder, this level D is referred to as a "second extinguishment position".)

In this embodiment, when the vibration sensor is subject to vibrations such as an earthquake to operate, the lever 47 is actuated to disengage the lock member 48 from the engaging portions 39*a* of the rotary member 39. In addition, since there is provided the manual extinguishment member 49 for manually operation of the lever 47, the engagement of the rotary member 39 with the lock member 48 can be removed by operating the member 49. In other words, if an extraordinary degree of burning occurs during use, operation of the manual extinguishment member 49 enables rapidly lowering the wick to the second extinguishment position to instantaneously complete fire extinguishing.

As apparent from the above description of the embodiment, the oil burner of the present invention is constructed such that, in order to ensure normal burning, the wick shaft is restricted so as not to be rotated beyond the range of normal rotation. Accordingly, burning is not caused when the level of the wick is inadvertently too low, and the restriction on the rotation of the wick shaft can be released to enable manual fire extinguishing by pushing and turning the knob, which action is ready in handling in terms of human engineering.

In addition, even when the present oil burner is subject to vibrations or falls down by accident, it is possible to lower the wick to the level of fire extinguishing independently of the restriction on the range of rotation for the wick shaft. Moreover, any additional operation for another use is unnecessary to give rise to a condition for burning only by turning the knob in the wick elevating direction, thus making the present oil burner satisfactory in safety and operation.

Hence, while preferred embodiments of the invention have been described and illustrated, it is to be understood that they are capable of variation and modification.

What is claimed is:

1. An oil burner comprising:

a wick shaft rotatable in opposite directions to raise a wick to a position for burning and to lower the same to a position for extinguishing a flame;

spring means for providing a bias force against said wick shaft, said bias force tending to rapidly lower said wick to the position for extinguishing a flame, said spring means having energy stored therein by rotation of said wick shaft to raise said wick;

a rotary member rotatably axially slidably mounted on said wick shaft, said rotary member being rotatable in a wick elevating and a wick lowering direction and having a plurality of engaging portions thereon;

a lock member for resiliently engaging with said engaging portions of the rotary member to lock said rotary member from rotating in the same direction as said wick shaft during a lowering of said wick;

a vibration sensor for sensing vibrations and in response thereto releasing the locking action of said lock member;

an actuation member mounted on said wick shaft and adapted to be resiliently contacted by said rotary member;

means for biassing said rotary member into resilient contact with said actuation member;

a stop member integrally provided on a surface of said rotary member, which surface contacts with said actuation member, for stopping said wick shaft at a predetermined position when it is rotating in the wick lowering direction; and, a slide shaft fitted on said wick shaft in a manner to rotate therewith and to be axially slidable thereon;

wherein when said slide shaft is pushed toward said rotary member and against the bias of said biassing means, said rotary member is axially moved to cause disengagement of said actuation member and said stop member, thus allowing said wick shaft to rotate in the direction of extinguishing a flame.

2. An oil burner as set forth in claim 1, further comprising a latch member provided on said rotary member and against which said actuation member on the wick shaft abuts when the wick is lowered to a level of extinguishing a flame by rotation of said wick shaft, said latch member being disposed such that said wick is stopped just above the lowest level at which the wick is positioned after the locking action of said vibration sensor means is released to cause the wick to rapidly descend by action of said spring means.

3. An oil burner comprising:

a wick shaft rotatable in opposite directions to raise a wick for burning and to lower a wick for extinguishing a flame;

a slide shaft fitted on said wick shaft in a manner to rotate therewith and to be axially slidable thereon;

a rotary member rotatably and axially slidably mounted on said wick shaft and having a plurality of engaging portions;

a first extinguishing spring means for providing a biassing force against said wick shaft, said biassing force tending to rapidly rotate said wick shaft and lower said wick to a level of extinguishing a flame, energy being stored in said first spring means by rotation of said wick shaft in a direction to raise said wick;

an actuation member mounted on said wick shaft and extending through an elongated hole of said slide shaft;

a second spring means for biassing said rotary member against said actuation member;

a lock member for resiliently engaging with said engaging portions of the rotary member to lock said rotary member from rotating in the same direction as that of said wick shaft during a lowering of said wick;

a weight for sensing vibrations and in response thereto for releasing the locking action of said lock member;

a latch member provided on said rotary member and against which said actuation member on the wick shaft abuts when the wick shaft is rotated to lower the wick to a level of extinguishing a flame; and a stop member integrally provided on the surface of said rotary member which surface contacts with said actuation member, for stopping said wick shaft at a predetermined position when rotating in the wick lowering direction.

4. An oil burner as set forth in claim 3, wherein said latch member on the rotary member is shaped to extend along a length on a rotary path of said actuation member.

5. An oil burner comprising:

a wick shaft rotatable in opposite directions to raise a wick for burning and to lower a wick for extinguishing a flame;

a slide shaft fitted on said wick shaft in a manner to rotate therewith and to be axially slidable thereon;

a rotary member rotatably and slidably mounted on said wick shaft and having a plurality of engaging portions;

a first extinguishing spring means providing a biassing force against said wick shaft, said biassing force tending to rapidly rotate said wick shaft in a direction of lowering said wick to a level of extinguishing a flame, energy being stored in said first spring means by rotation of said wick shaft in a direction to raise said wick;

an actuation member mounted on said wick shaft and extending through an elongated hole of said slide shaft;

a second spring means for biassing said rotary member against said actuation member;

a lock member for resiliently engaging with said engaging portions of the rotary member to lock said rotary member from rotating in the same direction as said wick shaft during a lowering of said wick;

a weight for sensing vibrations and in response thereto for releasing the locking action of said lock member;

a latch member provided on said rotary member and against which said actuation member on said wick shaft abuts when the wick shaft is rotated to lower the wick to a level of extinguishing a flame; and a stop member provided on the surface of said rotary member which surface contacts with said actuation member, for stopping said wick shaft at a predetermined position when rotating in the wick lowering direction.

* * * * *